US008555431B2

(12) United States Patent
Nielsen

(10) Patent No.: US 8,555,431 B2
(45) Date of Patent: Oct. 15, 2013

(54) LINEAR ACTUATOR DEVICE

(75) Inventor: Jens Jørgen Nielsen, Broager (DK)

(73) Assignee: Linak A/S, Nordborg (DK)

( * ) Notice: Subject to any disclaimer, the term of this patent is extended or adjusted under 35 U.S.C. 154(b) by 505 days.

(21) Appl. No.: 12/223,979

(22) PCT Filed: Feb. 16, 2007

(86) PCT No.: PCT/DK2007/000076
§ 371 (c)(1),
(2), (4) Date: Aug. 14, 2008

(87) PCT Pub. No.: WO2007/093181
PCT Pub. Date: Aug. 23, 2007

(65) Prior Publication Data

US 2010/0224017 A1 Sep. 9, 2010

(30) Foreign Application Priority Data

Feb. 18, 2006 (DK) ..... 2006 00234

(51) Int. Cl.
*F16H 29/02* (2006.01)
*A47C 17/04* (2006.01)

(52) U.S. Cl.
USPC ..... 5/16; 5/17; 74/89.23

(58) Field of Classification Search
USPC ..... 74/89.23, 89.32, 89.33, 89.34; 411/297, 411/941.2; 5/16, 17, 18
See application file for complete search history.

(56) References Cited

U.S. PATENT DOCUMENTS 4,372,223 A * 2/1983 Iwatani ..... 108/143
4,693,128 A * 9/1987 Plow ..... 74/104

(Continued)

FOREIGN PATENT DOCUMENTS

CH 615333 1/1980
DE 3842078 7/1989

(Continued)

OTHER PUBLICATIONS

English Abstract of DE3842078.

(Continued)

*Primary Examiner* — Justin Krause
*Assistant Examiner* — Gregory Prather
(74) *Attorney, Agent, or Firm* — Dykema Gossett PLLC

(57) ABSTRACT

A linear actuator device for pieces of furniture, e.g. beds, is described which include an adjustable section (2, 3) pivotally embedded in a frame (1). The section (2, 3) is raised and lowered by at least one rod (23, 24) mounted on a pivot shaft (4, 6). The actuator comprises a housing (8) with a bushing (10) receiving the pivot shaft (4, 6), and a spindle (14) driven by a low-voltage DC motor (11). The spindle (14) carries a spindle nut (12) fixed against rotation which in one direction of motion operates an arm (5, 7) mounted on the pivot shaft (4, 6) for adjusting the section within the piece of furniture. By designing the arm (5, 7) such that, when it engages the spindle nut (12), it will rest against an area (17) of the nut's end which faces farthest away from the shaft, an expedient moment curve for pivoting the section is obtained, as a large moment occurs at the beginning and the end of the section's movement just when needed. In the initial horizontal position of the section, a large moment is needed, and so is in the end position, when for instance a mattress is folded which requires a large moment. The area, which the end of the arm (5, 7) rests against is expediently equipped with a roller (17) which reduces friction and wear on the spindle nut.

5 Claims, 5 Drawing Sheets

(56) References Cited

U.S. PATENT DOCUMENTS

| | | | | |
|---|---|---|---|---|
| 5,075,911 | A | 12/1991 | Dewert | |
| 5,116,038 | A * | 5/1992 | Kim | 271/10.11 |
| 6,381,795 | B1 * | 5/2002 | Hofmann et al. | 15/28 |
| 2004/0099071 | A1 * | 5/2004 | Bai | 74/56 |
| 2007/0285035 | A1 | 12/2007 | Roither et al. | |
| 2008/0121852 | A1 | 5/2008 | Koch | |

FOREIGN PATENT DOCUMENTS

| | | |
|---|---|---|
| DE | 29607493 | 8/1996 |
| DE | 29612493 | 10/1996 |
| DE | 19752234 | 6/1999 |
| DE | 20210187 | 12/2003 |
| WO | 2005122841 | 12/2005 |
| WO | WO 2005122841 A1 * | 12/2005 |

OTHER PUBLICATIONS

English Abstract of DE19752234.

English Abstract of DE20210187.

English Abstract of CH615333.

* cited by examiner

LINEAR ACTUATOR DEVICE

BACKGROUND OF THE INVENTION

1. Field of the Invention

The present invention relates to a linear actuator device.

2. The Prior Art

This kind of linear actuator device is used for beds and chairs with at least one adjustable section pivotally embedded in a frame. The section is raised and lowered by means of one or two rods mounted on a pivot axis. On the pivot axis an arm is in engagement with a spindle nut forming part of the actuator. The actuators are in the form of one embodiment in which a separate drive unit in a joint housing is placed at each end, or of another embodiment having only one drive unit. The first one of these embodiments is, e.g., known from EP 0 372 032 to Dewert and the second one from WO 2005/112709 A1 to Dewert.

Typically, the spindle nut is designed and shaped from plastic material as a quardrangular sliding element, with an arm on the pivot axis resting against one end face thereof. Normally, the arm is made from metal, and the spindle nut is highly exposed to wear at the position at which the arm rests against said spindle nut. The spindle nut will be made from plastic material following the requirements for low noise level as well as for minimum friction and also the demand for low manufacturing costs.

Also, there is the issue of the forces involved. As the arm pivots about a point thus describing a circular arc while, at the same time, the spindle nut performs a linear movement, this causes the place of engagement of the arm at the end of the spindle nut to move. During the introductory movement when the section is raised, the lever arm is short as the arm then lies high on the end of the spindle nut. During further movement the length of the moment arm increases and decreases at the end, when the section approaches its fully upright position. This resembles a moment curve, which rises from a certain level and then decreases again. Such a course of the moment curve is not particular expedient. The section also describes an arc of a circle, wherein the moment curve is largest when the section is in a horizontal position and the lever or moment arm decreases in correspondence with the raising of the section. Thus, at the beginning a large moment is needed, which does not match with the moment curve of the actuator. Towards the fully upright position a large moment is needed as well, which for a bed is due to the fact that the mattress which often is rather thick must be bent by a certain angle. This requires a moment of a considerable size. Ideally, the position of engagement of the arm would permanently lie exactly in the longitudinal axis of the spindle to avoid biassing of the spindle. For the largest possible torque applied on the respective section, the arm should be as long as possible. However, this is inconsistent with the requirement for minimum height of installation of the actuator.

In contrast to a fairly long arm at the end of the spindle nut, which, for example is known from EP 0 372 032 B1 to Dewert and DE 38 42 078 C2 to Okin, constructions have recently been suggested having a short arm with two legs riding astride the spindle and engaging both sides of the end face of the spindle nut, as, for example, is shown in WO 2005/110158 A1 to Okin. The problem concerning the length of the moment arm is, for instance, discussed in DE 296 07 493 U1 to Dewert. The document suggests a specific embodiment for both the arm and the spindle nut. The arm is constructed as an inverted V, with one leg being designed for engaging the front part of the spindle nut.

The other leg extends into an opening in the front part of the spindle nut and is intended for engaging a surface in the opening facing forward. During the pivoting movement one of the legs rests against the front surface of the spindle nut and is released at a given angle and the other leg engages the surface in the opening. This, to a certain degree, helps to balance the length of the moment arm.

The object of the invention is to achieve an enhanced course of the moment curve for the arm.

SUMMARY OF THE INVENTION

According to the invention this is achieved by means of an embodiment of the actuator device wherein the arm is designed such that, when it engages the spindle nut, it will rest against an area towards the side of the spindle nut situated farthest away from the pivot shaft, so that the longest possible moment arm for the given construction is obtained. Herein, the moment curve has a course which starts with a fairly high moment, then decreases and then rises again, that is, the largest moment is during both the introductory movement of the section and during the closing movement, during which positions or periods of movement the largest moment is needed. This permanently causes a biassing force on the spindle, which, however, is not larger than in the known constructions.

Expediently, the spindle nut is constructed with a roller or a wheel for engaging the arm. This, primarily, results in low friction, so that thereby higher efficiency may be obtained. At the same time wear on the ends of the spindle nut is reduced. The roller can thus be made from a material having increased hard-wearing properties when compared with the remainder of the nut; moreover the roller may be designed to bring about self-lubricating qualities. For the sake of completeness it is noted that a construction is known from DE 197 52 234 A1 to Hanning wherein the arm itself on the pivoting shaft is equipped with a ball bearing, which is a more difficult and exposed construction.

Embodiments of the present invention will now be explained in greater detail with reference to the accompanying drawings.

DETAILED DESCRIPTION OF THE PREFERRED EMBODIMENT

Figure 1:
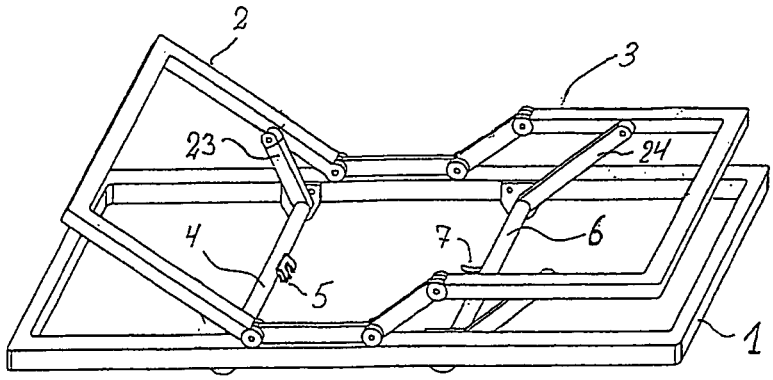
FIG. 1 shows a (slatted) frame for a bed with raised upper body and leg sections.

As it appears from FIG. 1 a slatted bed as, e.g., to be used in a hospital bed comprises a basic frame 1, in which there is embedded an upper body section 2 and an articulated leg section 3. A transverse shaft 4 carrying a short arm 5 is embedded in the frame for operating the upper body section 2. One rod 23 each connected to the upper body section 2 is mounted on each end of pivot shaft 4. In a similar manner, and regarding leg section 3, there is a pivot shaft 6 carrying a short arm 7 for operating leg section 3. Also, there is one rod 24 each mounted on the ends of shaft 6 and connected to leg section 3.

Figure 2:
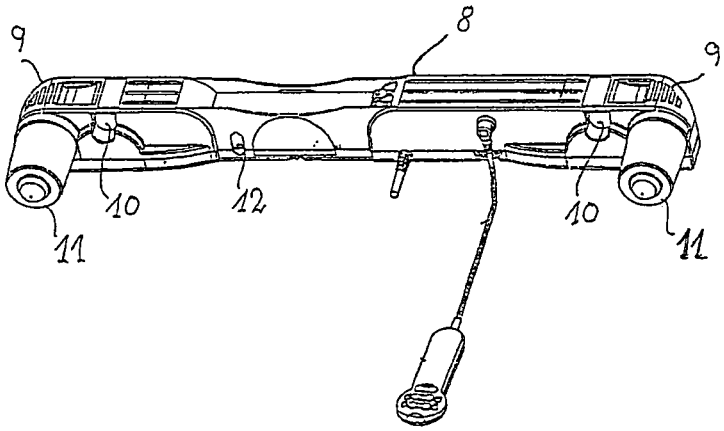
FIG. 2 shows a perspective view of a dual actuator.
Figure 2A:
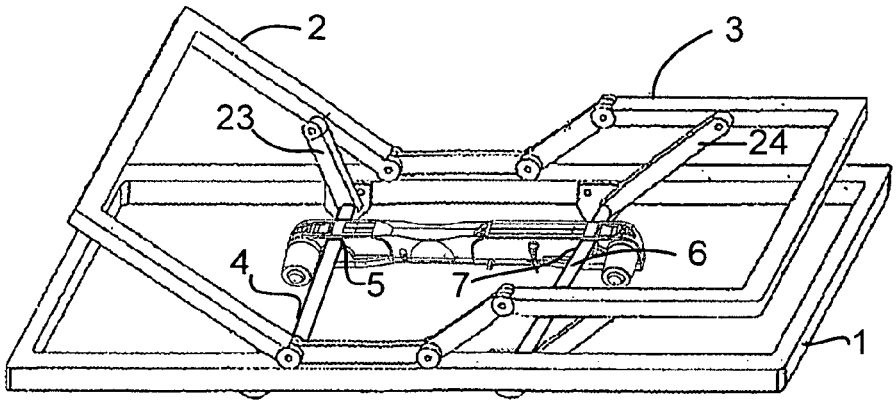
FIG. 2*a* shows the dual actuator positioned on the (slatted) frame.
Figure 3:
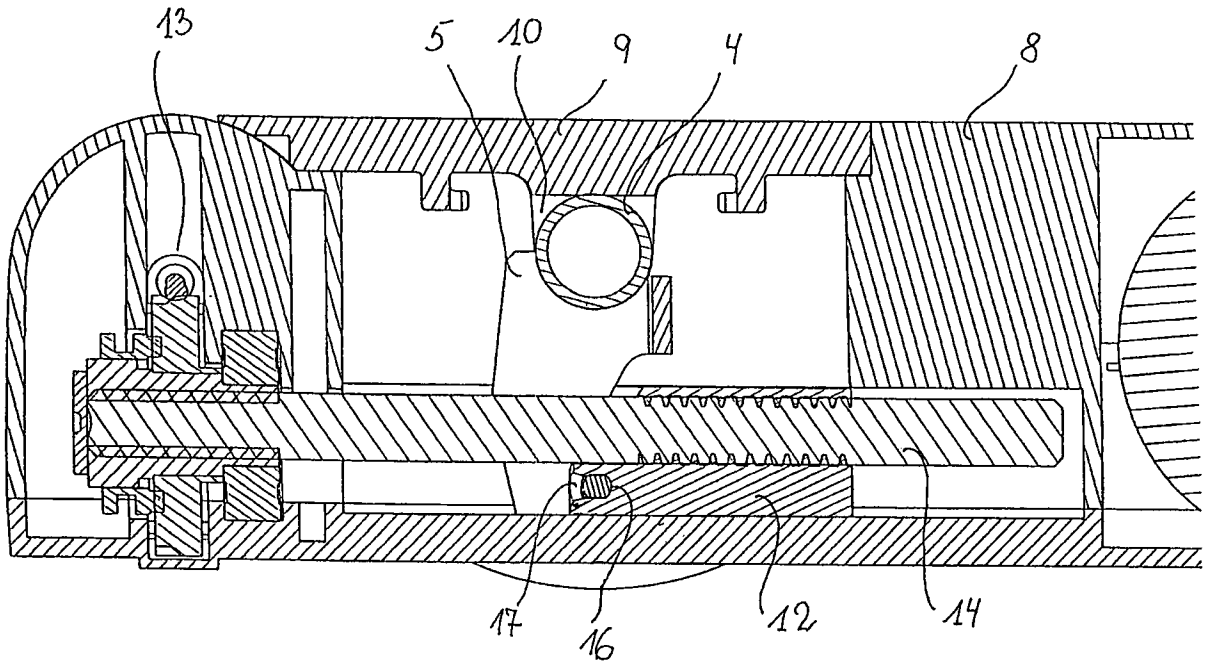
FIG. 3 shows a longitudinal sectional view of the left end of the actuator shown in FIG. 2 for actuating the head section of the frame.
Figure 4:
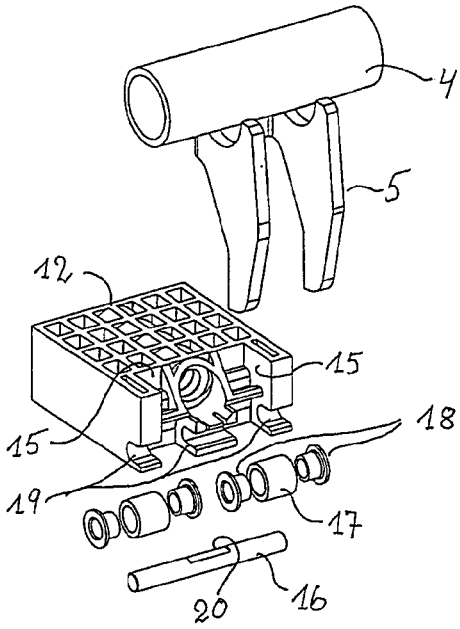
FIG. 4 shows an exploded perspective view of a spindle nut and claw.
Figure 6:
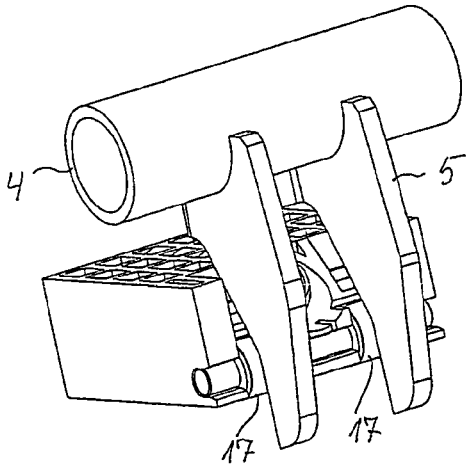
FIG. 6 shows a perspective view of the spindle nut and claw seen from the front.
Figure 5:
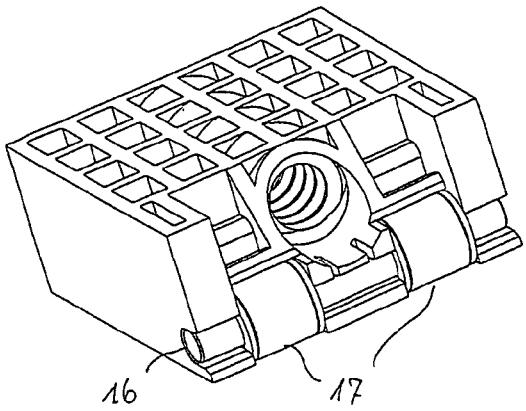
FIG. 5 shows a perspective view of the spindle nut seen from the front.

The movement of the upper body- and leg-sections 2,3 is achieved by means of a dual actuator device as shown in FIG. 2. This actuator device comprises a housing 8 having a sliding cover 9 at the ends, the cover enabling access to a transverse shaft opening 10 forming a bushing. A drive is provided in functional connection with the shaft openings and is driven by a low-voltage DC motor 11, mounted essentially perpendicular to the main housing 8. Motor 11 drives a spindle 14 via a worm gear 13. The spindle carries a spindle nut 12 designed as a sliding element. This is fixed against rotation within the housing 8. By rotation of spindle 14 the sliding element 12 is moved back and forth, respectively, depending on rotary direction of the spindle. As the arm 5 on swiveling or pivot shaft 4 of upper body section 2 engages the end of sliding element 12, the upper body section will be turned up and down, respectively, following rotation of spindle 14. The drive at the other end of the dual actuator operates the leg section 3 in a similar manner as described before in context with upper body section 2.

The dual actuator device is mounted on the slatted bed by pulling the sliding covers 9 outwards and guiding the actuator inwards until the pivot shafts 4,6 are fully seated in the bushing-forming openings 10 and the respective portions of arms 5,7. The covers 9 are closed again by sliding inwardly, whereby the actuator is suspended from the pivot shafts 4,6. When the drives are activated, the pivot shafts will be swiveled, which causes the upper body and the leg sections, respectively, to be raised or lowered, depending on the direction of rotation of the drive as explained above.

FIGS. 3 to 6 of the drawings will be described in the following with reference to the upper body section 2, only. The arm 5 on swiveling or pivot shaft 4 is a claw-shaped element having two legs by which it straddles the spindle 14. In the front part of the spindle nut 12, which can be made from plastic material, there are two notches 15, at the bottoms of which there is arranged a roller 17 mounted on two bushings 18 which are seated on a mutual axle 16. This axle 16 together with the rollers 17 mounted thereon is held in a snap lock fit in grooves 19 designed for such purpose. Axle 16 is fixed against lateral displacement with the aid of a cut-out or recess portion 20, which fits in a middle portion of groove 19 holding axle 16. To this end, a snap lock fit is sufficient as the rollers 17 are never charged by traction forces, but are solely pressure loaded or released. The claw shaped arm 5 engages the rollers 17 by its lower ends.

It should be noted that the opposite end of the actuator, which operates the leg section 3 and the arm 7 on the pivot shaft 6 is designed in a similar manner as to what has been described in the foregoing.

Figure 7:
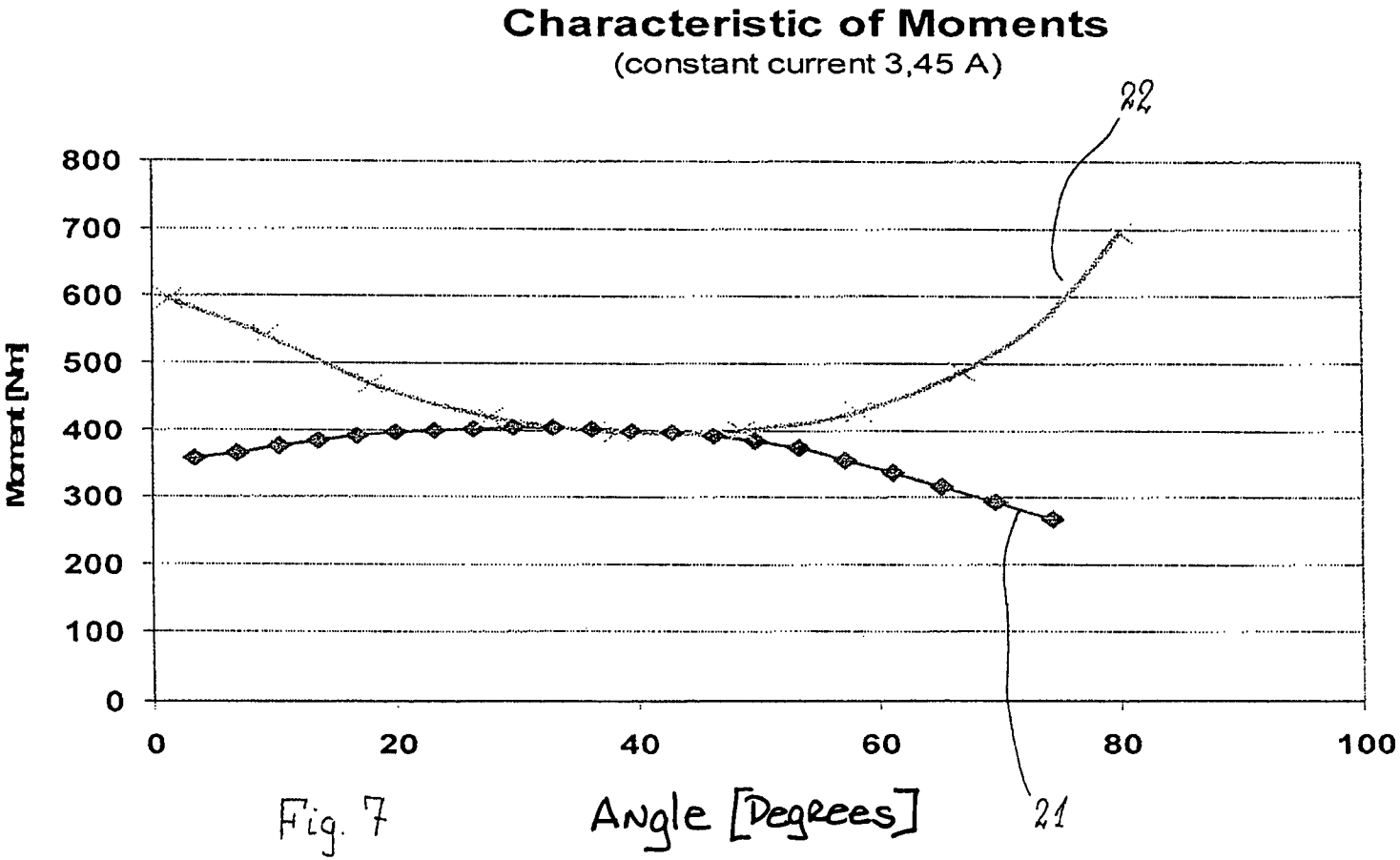
FIG. 7 shows a diagram of two moment curves, one characteristic of the actuator according to the invention and one of a known construction, respectively.

In FIG. 7 of the drawings there are shown two moment curves, of which a curve 21 represents the moment curve of a hitherto known actuator in which the arm rides astride the spindle and engages the end face of the sliding element on both sides of the spindle. The second curve 22 reflects the moment curve for an actuator according to the invention. In the prior art construction the moment is very low at the beginning of movement and at its end, whereas the curve representing the construction according to the invention shows the highest values of the moment at the beginning of the movement and at its end, just when the highest moment possible is needed.

The invention claimed is:

1. An item of furniture which comprises:

a frame, a first adjustable section pivotally attached to the frame, a first pivot shaft connected to said frame for pivoting said first adjustable section relative to the frame, said first pivot shaft including a first arm, a linear actuator which includes a housing with a bushing means for the first pivot shaft, a first spindle, a first electric motor for rotating the first spindle, and a first spindle nut on said first spindle, said first spindle nut being prevented from rotation so as to move along said first spindle based on rotation direction of said first spindle, said first spindle nut having an end face which is generally perpendicular to said first spindle and defines a first notch therein, an upperside, an underside, and a first roller mounted in said first notch next to said underside, said first spindle nut being located in the housing such that the upperside thereof is located closest to the bushing means and the underside thereof farthest from the bushing means, and wherein the first pivot shaft extends in the bushing means of said housing, and said first arm of the first pivot shaft includes a first leg which has a distal end that rests against said first roller, said first roller being contacted on a periphery thereof only by said first leg.

2. The item of furniture as claimed in claim 1, wherein said end face of said first spindle nut includes a second notch therein, wherein a second roller is mounted in said second notch next to said underside, and wherein said first arm includes a second leg which rests against said second roller, said second roller being contacted on a periphery thereof only be said second leg.

3. The item of furniture as claimed in claim 2, including an axle in said end face of said first spindle nut so as to extend across said first and second notches, and wherein said first and second rollers are rotatably mounted on said axle.

4. The item of furniture as claimed in claim 3, wherein said end face of said first spindle nut includes a plurality of grooves in which said axle snap fits.

5. The item of furniture as claimed in claim 4, wherein said axle includes a recess which cooperates with one of said plurality of grooves to prevent lateral displacement of said axle relative to said first spindle nut.

* * * * *

UNITED STATES PATENT AND TRADEMARK OFFICE

CERTIFICATE OF CORRECTION

PATENT NO. : 8,555,431 B2
APPLICATION NO. : 12/223979
DATED : October 15, 2013
INVENTOR(S) : Jens J\orgen Nielsen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 639 days.

Signed and Sealed this
Fifteenth Day of September, 2015

Michelle K. Lee

Michelle K. Lee
*Director of the United States Patent and Trademark Office*